US005996177A

United States Patent [19]

Cheng

[11] Patent Number: 5,996,177

[45] Date of Patent: Dec. 7, 1999

[54] HANDLE ASSEMBLY FOR A COLLAPSIBLE LUGGAGE TROLLEY

[76] Inventor: Shih-Min Cheng, No. 1-2, Lane 132, Lin-Jiang Road, Da-Jia Town, Taichung Hsien, Taiwan

[21] Appl. No.: 09/108,214

[22] Filed: Jul. 1, 1998

[51] Int. Cl.[6] ..... A47B 95/02

[52] U.S. Cl. ..... 16/113.1; 280/655; 280/655.1

[58] Field of Search ..... 16/115; 190/15.1, 190/115, 18 A; 280/655, 655.1

[56] References Cited

U.S. PATENT DOCUMENTS

| | | | |
|---|---|---|---|
| 5,371,923 | 12/1994 | Chang | 16/115 |
| 5,553,350 | 9/1996 | Chang | 16/115 |
| 5,689,854 | 11/1997 | Wang | 16/115 |
| 5,875,520 | 3/1999 | Chang | 16/115 |

*Primary Examiner*—Chuck Y. Mah
*Attorney, Agent, or Firm*—Rosenberg, Klein & Lee

[57] ABSTRACT

A handle assembly is provided for a collapsible luggage trolley of the type having two outer tubes and two inner tubes respectively, telescopically received in the outer tubes. Each inner tube includes a link received therein for controlling telescopic movements of the inner tube relative to the outer tube. The handle assembly includes a handle having two ends each having an operative surface. The handle is manually rotatable relative to the end blocks to cause the operative surfaces to exert a force on the links for controlling telescopic movements of the inner tubes relative to the outer tubes. Two end blocks are respectively connected to the ends of the handle. Each end block has a first end rotatably connected to an associated end of the handle and a second end connected to an associated link to move therewith. A button member is mounted in a compartment of the handle and includes two rods respectively extending outwardly from two ends thereof. Each rod is engaged with the associated link to move therewith for controlling telescopic movements of the inner tubes relative to the outer tubes upon manual press of the button member

3 Claims, 7 Drawing Sheets

HANDLE ASSEMBLY FOR A COLLAPSIBLE LUGGAGE TROLLEY

BACKGROUND OF THE INVENTION

1. Field of the Invention

The present invention relates to a collapsible luggage trolley that can be operated by either rotating or pressing a handle thereof.

2. Description of the Related Art

FIG. 8 of the drawings illustrate a conventional collapsible luggage trolley 80 that includes a recessed area 81 in an upper end thereof for receiving a handle 50 in a lowermost position. FIG. 7 illustrates a typical arrangement of the handle assembly for the luggage trolley 80. The handle assembly includes a handle 50 and two L-shaped end blocks 60 respectively attached to two ends of the handle 50. Each end block 60 includes an L-shaped hole 61 defined therein. An inner tube 70 is attached to a lower end of each end block 60 and is telescopically received in an associated outer tube 74. Each end of the handle 50 includes a peg 51 for engaging with an upper loop end 72 of a link 71 that is received in an associated inner tube 70. A lower loop end 73 of each link 71 is engaged with a retaining means (including members 75 and 76) for releasably engaging with a toothed member 78 securely mounted in an associated outer tube 74. When the handle 50 is rotated relative to the end blocks 60, the links 71 are lifted and thus cause disengagement of the retaining means and the toothed members 78 to allow vertical movements of the handle 50 and the inner tubes 70 relative to the outer tubes 74. Nevertheless, as shown in FIG. 8, when the handle 50 is at its lowermost position received in the recessed area 81, it is difficult to rotate the handle 50. The present invention is intended to provide an improved handle assembly to solve this problem.

SUMMARY OF THE INVENTION

It is a primary object of the present invention to provide an improved handle assembly for a collapsible luggage trolley that allows the handle to be either rotated or pushed.

In accordance with the present invention, a handle assembly is provided for a collapsible luggage trolley of the type having two outer tubes and two inner tubes respectively, telescopically received in the outer tubes, in which each inner tube includes a link received therein for controlling telescopic movements of the inner tube relative to the outer tube.

The handle assembly comprises a handle having two ends each having an operative surface. The handle is manually rotatable relative to the end blocks to cause the operative surfaces to exert a force on the links for controlling telescopic movements of the inner tubes relative to the outer tubes. Two end blocks are respectively connected to the ends of the handle. Each end block has a first end rotatably connected to an associated end of the handle and a second end connected to an associated link to move therewith.

A button member is mounted in a compartment of the handle and includes two rods respectively extending outwardly from two ends thereof. Each rod is engaged with the associated link to move therewith for controlling telescopic movements of the inner tubes relative to the outer tubes upon manual press of the button member.

A spring is mounted in the compartment of the handle and includes a first end attached to the handle and a second end attached to the button member to return the button member to its initial position. Preferably, two torsion springs are respectively mounted to the ends of the handle. Each torsion spring includes a first end securely attached to the associated end of the handle and a second end securely attached to an associated end block for returning the handle to its initial position.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
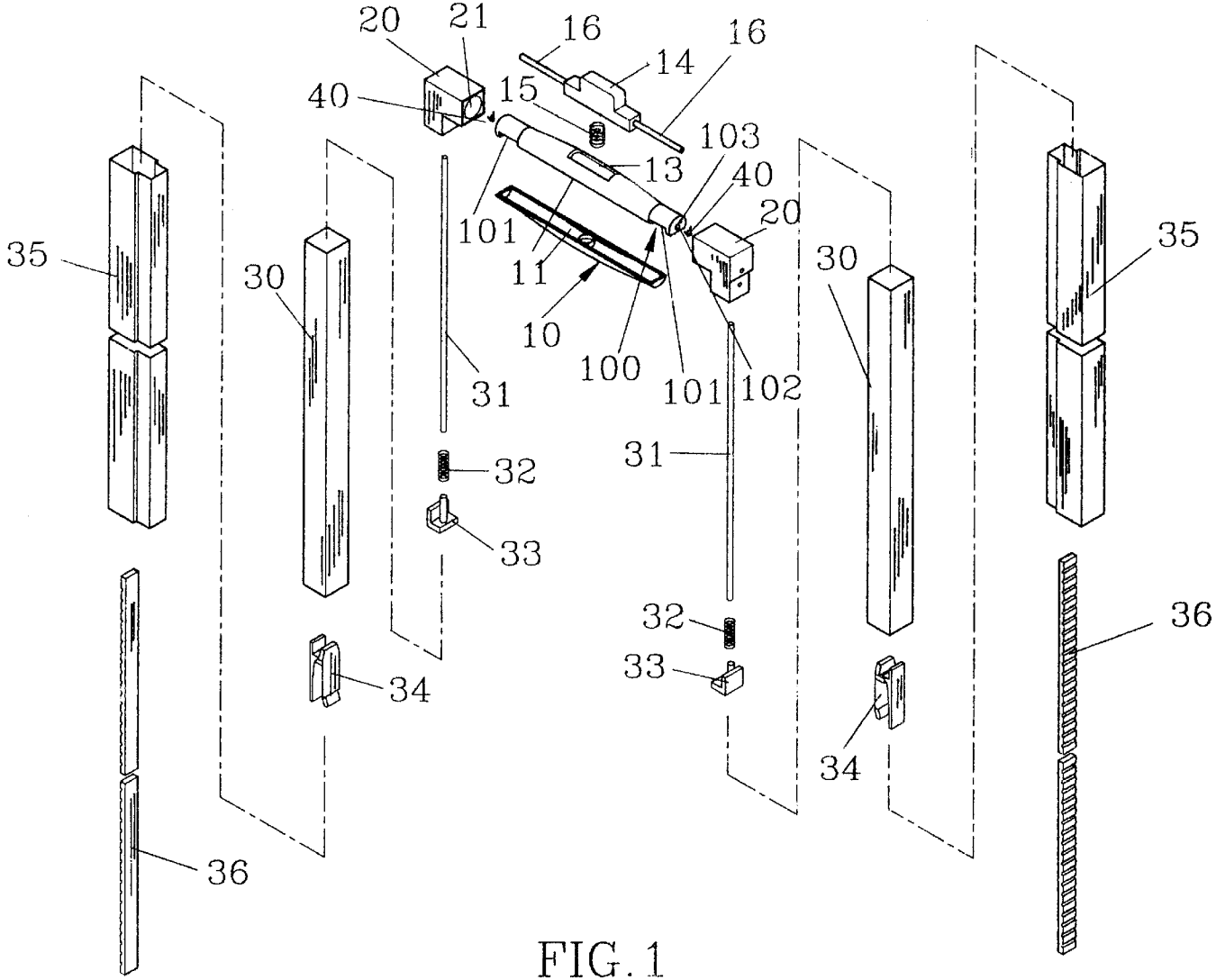
FIG. 1 is an exploded perspective view of a handle assembly for a collapsible luggage trolley in accordance with the present invention.
Figure 2:
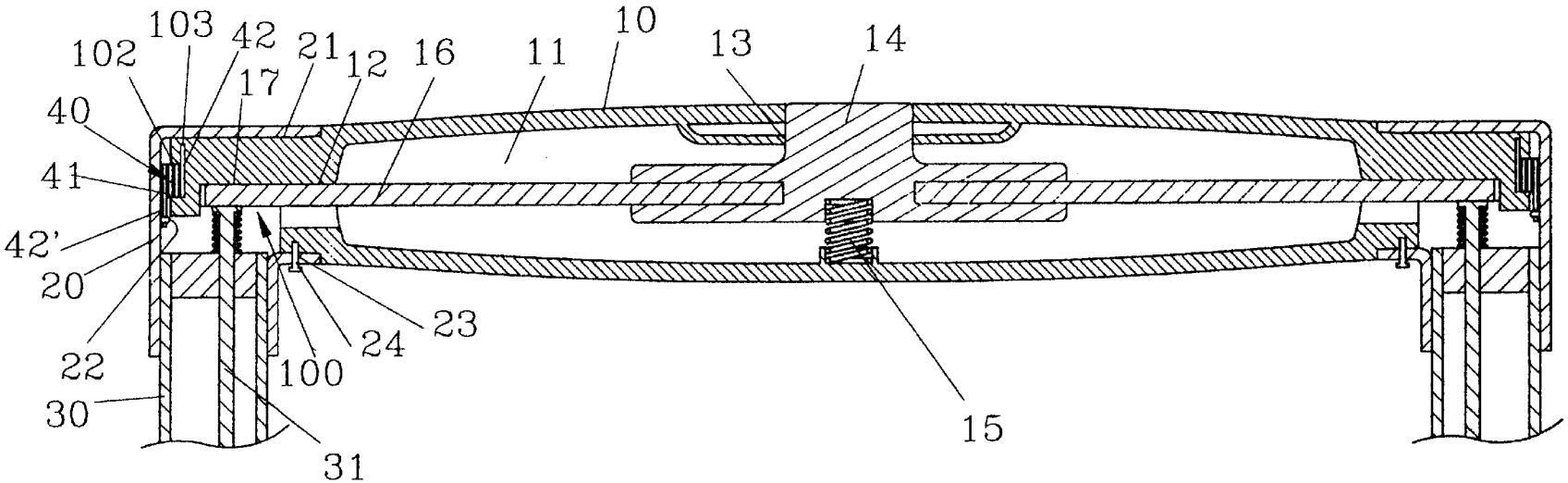
FIG. 2 is a sectional view of the handle assembly in accordance with the present invention.

Referring to the FIGS. 1 to 6 and initially to FIGS. 1 and 2, a handle assembly for a collapsible luggage trolley in accordance with the present invention generally includes a handle 10 and two L-shaped end blocks 20 each having an L-shaped hole 21 defined therein. Each end block 20 includes a first end rotatably engaged with an associated end of the handle 10 and a second end securely engaged with an upper end of an associated inner tube 30 to move therewith. Each inner tube 30 is telescopically received in an associated outer tube 35. A link 31 is received in each inner tube 30 and includes an upper end connected to an associated end of the handle 10 and a lower end which is connected to a retaining means (including members 32, 33, and 34) which, in turn, is releasably engaged with a toothed member 36 mounted in an associated outer tube 35. Arrangement and operation of the retaining means and the toothed members 36 are conventional and therefore not further described.

Figure 3:
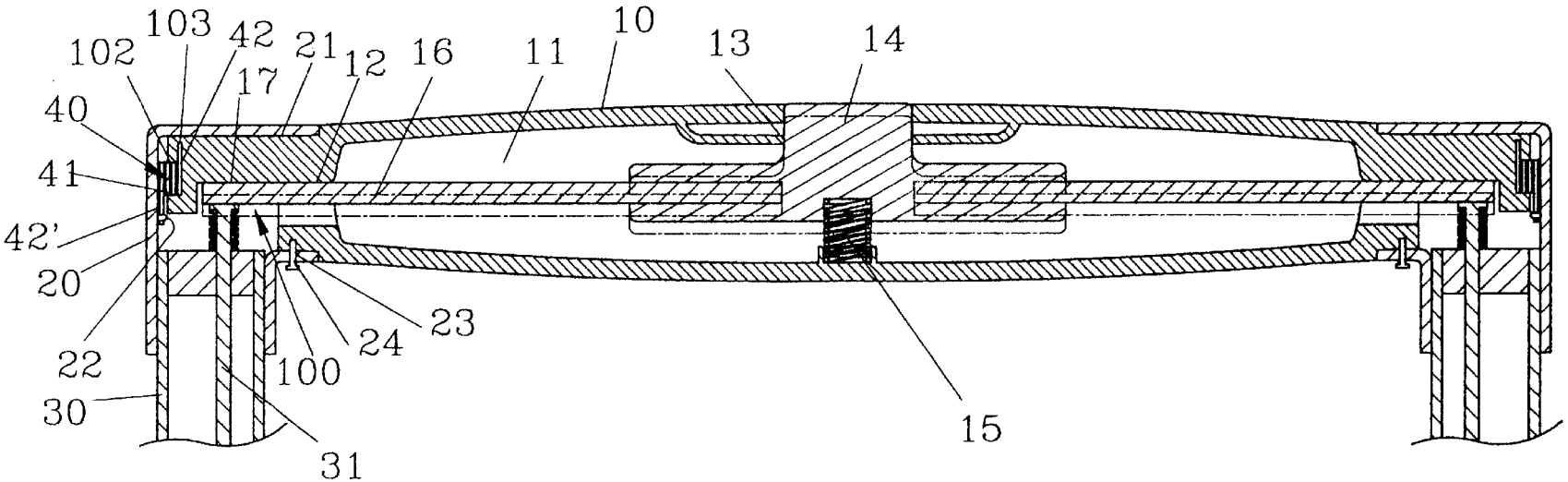
FIG. 3 is a sectional view similar to FIG. 2, illustrating press operation of the handle assembly.
Figure 4:
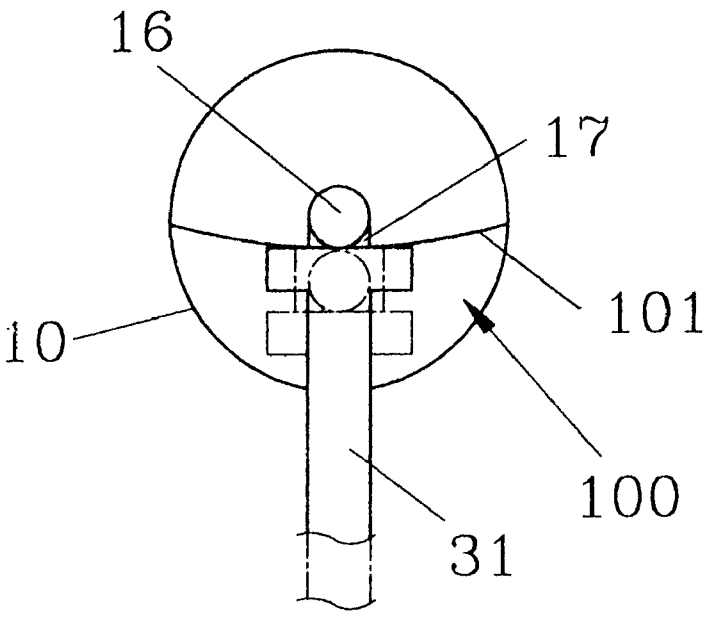
FIG. 4 is a schematic side view illustrating press operation of the handle assembly.

Still referring to FIGS. 1 and 2, the handle 10 includes upper and lower portions that together define a compartment 11 therebetween for receiving a button member 14 therein. The upper portion of the handle 10 includes a slot 13 defined in an upper side thereof for receiving an end of the button member 14. A spring 15 is mounted in the compartment 11 of the handle 10 and includes a first end attached to the lower portion of the handle and a second end attached to the button member 14 to bias the button member 14 upwardly. The button member 14 further includes two rods 16 respectively extended outwardly to the two ends of the handle 10 for respectively engaging with upper ends of the links 31. When the button member 14 is pressed downwardly, as shown in FIGS. 3 and 4 (see the phantom lines), the rods 16 urge the links 31 to move downwardly which causes disengagement of the retaining means from the toothed members 36 to allow vertical movements of the inner tubes 30 and the handle 10 relative to the outer tubes 35. Release of the button member 14 causes the retaining means 10 re-engage with the toothed members 36 to retain the inner tubes 30 in position, which is conventional and therefore not further described.

Still referring to FIGS. 1 and 2, the handle 10 further includes a recessed section 100 defined in each of two ends thereof, each recessed section 100 including an operative surface 101. In addition, a positioning groove 103 is defined in each of two end faces of the handle 10, and a torsion spring 40 is mounted to each end face of the handle 10. In this embodiment, each torsion spring 40 includes a coil portion 41 received in a space 102 defined between each end face of the handle 10 and the associated end block 20. Each torsion spring 40 further includes a first end 42 securely positioned in an associated positioning groove 103 and a second end 42' securely attached to a protrusion 22 formed on an inner periphery of the associated end block 20. Each end block 20 further includes an arcuate hole 23 defined in a horizontal end thereof which is connected to an associated end of the handle 10, and a screw 24 is extended through the arcuate hole 23 to secure the end block 20 to the end of the handle 10 yet allows relative rotational movements between the end block 20 and the handle 10.

In assembly, the button member 14 with two rods 16 is placed into the compartment 11 of the handle 10, wherein the distal end of each rod 16 is extended into an insert groove 17 (FIG. 2) defined in the associated end of the handle 10. The upper and lower portions of the handle 10 are then assembled together. Next, the spring 15 is mounted between the button member 14 and lower portion, and the upper and lower portions of the handle 10 are then riveted together. The torsion springs 40 are respectively mounted to two end faces of the handle 10 in a manner described above. Thereafter, the screws 24 are respectively extended through the arcuate slots 23 to finish the assembly.

Figure 5:
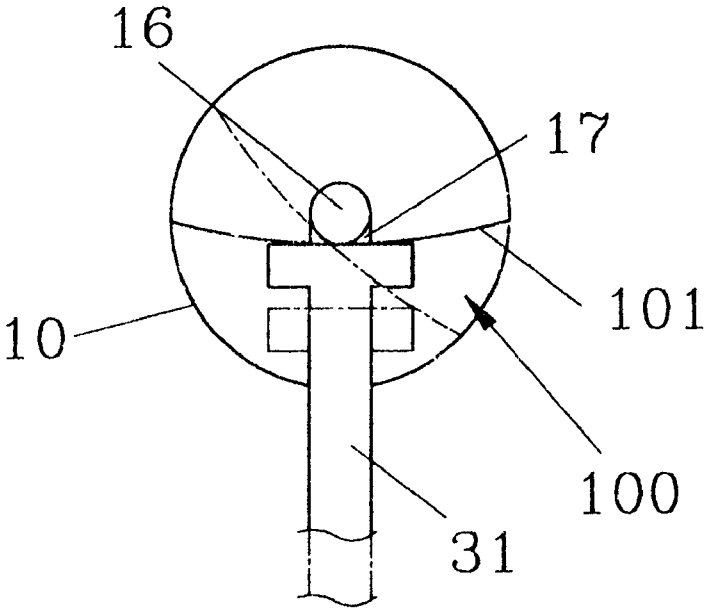
FIG. 5 is a view similar to FIG. 4, illustrating rotate operation of the handle assembly.
Figure 8:
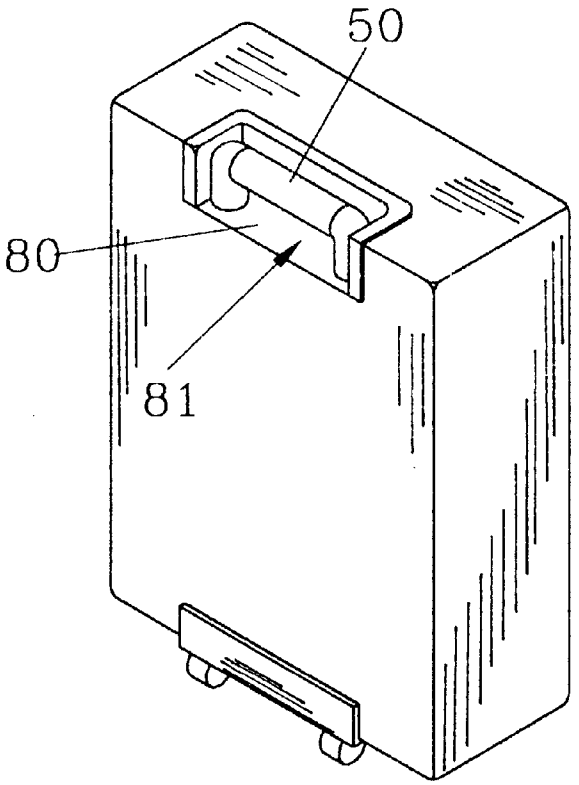
FIG.8 PRIOR ART
FIG. 8 is a perspective view of a conventional collapsible luggage trolley.

As described above, the button member 14 may be pressed to allow vertical movements of the inner tubes 30 relative to the outer tubes 35. This is especially advantageous when the 0handle 10 is in its lowermost position (FIG. 8) as the user may easily operate the handle. Alternatively, the user may rotate the handle 10 which, as shown in FIG. 5, causes downward movement of the inner tubes 30 as the operative surfaces 101 respectively exert a downward force on upper ends of the inner tubes 30 (see the phantom lines in FIG. 5). As a result, each retaining means is disengaged from the associated toothed member 36 to allow vertical movements of the inner tubes 30 relative to the outer tubes 35 as described above.

Figure 6:
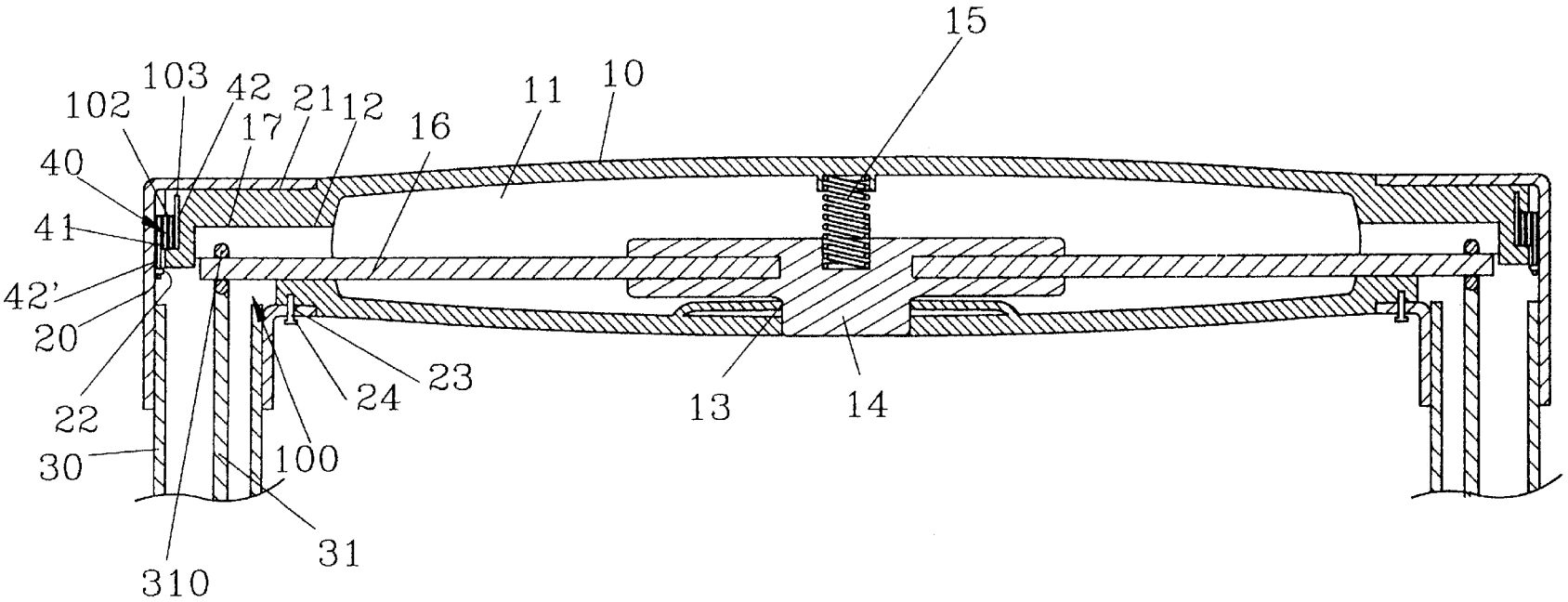
FIG. 6 is a sectional view illustrating a modified embodiment of the handle assembly.
Figure 7:
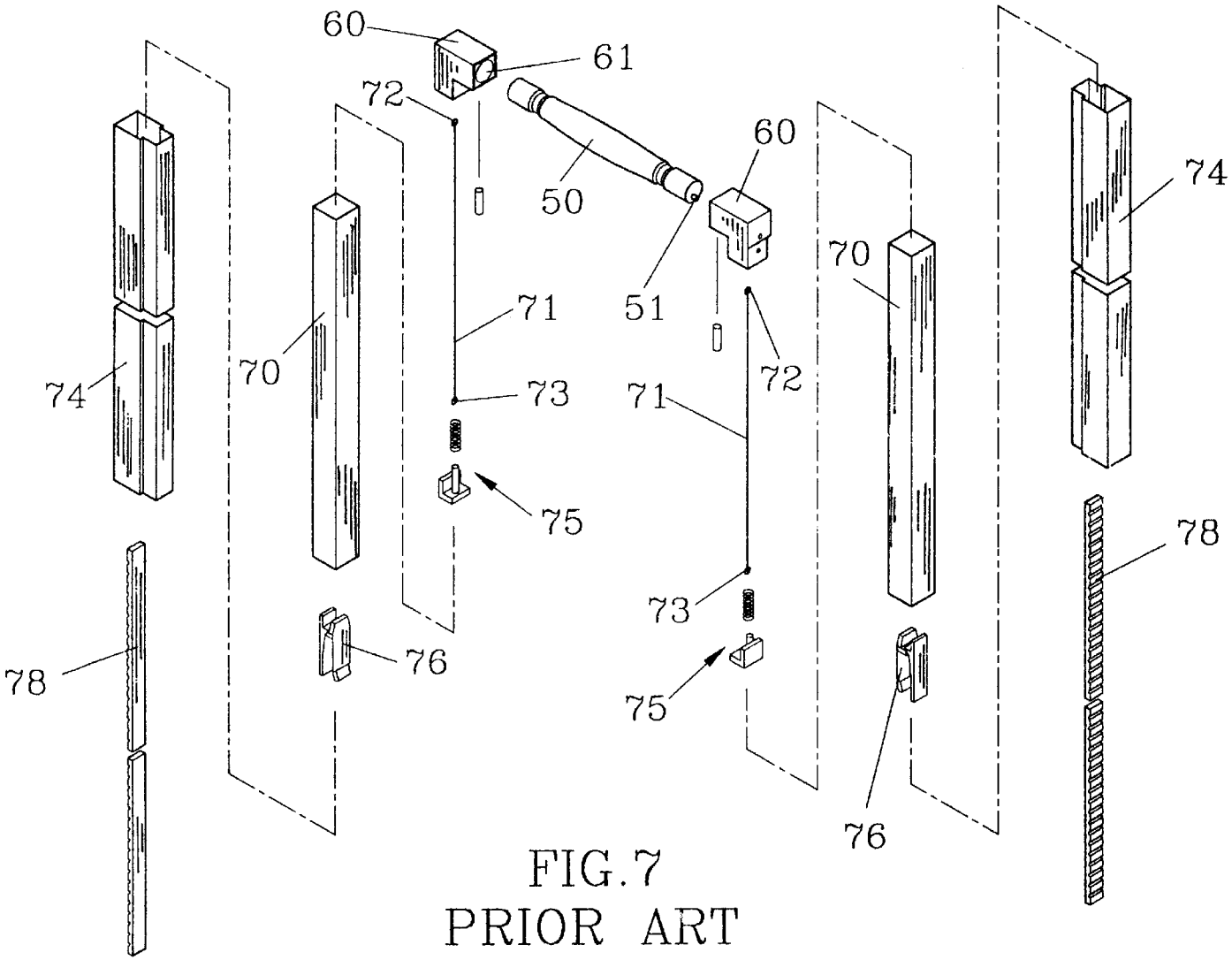
FIG. 7 PRIOR ART
FIG. 7 is an exploded perspective view of a conventional handle assembly for a collapsible luggage trolley.

FIG. 6 of the drawings illustrates a modified embodiment of the handle assembly, wherein the slot 13 for receiving an end of the button member 14 is defined in the lower portion of the handle 10 instead of the upper portion, while the spring 15 is mounted between the upper portion of the handle 10 and the button member 14. In addition, the distal end of each rod 16 is securely engaged with the upper end 310 of the associated link 31 to move therewith. Operation of the handle assembly in FIG. 6 is substantially the same as that described above, except for that the button member 14 is now pressed upwardly.

According to the above description, it is appreciated that the handle of the present invention can be either rotated or pressed to achieve the same function to allow vertical movements of the inner tubes relative to the outer tubes of a collapsible luggage trolley. Namely, the user may select the most convenient way to control the status of the luggage trolley.

Although the invention has been explained in relation to its preferred embodiment, it is to be understood that many other possible modifications and variations can be made without departing from the spirit and scope of the invention as hereinafter claimed.

What is claimed is:

1. A handle assembly for a collapsible luggage trolley having two outer tubes and two inner tubes respectively, telescopically received in the outer tubes, each said inner tube including a link received therein, the link having a retaining assembly coupled thereto and being releasably engaged to a toothed member coupled to a respective one of the outer tubes for controlling telescopic movements of the inner tubes relative to the outer tubes, the handle assembly comprising:

a handle having two ends each having an operative surface, the handle including a compartment defined therein, two end blocks respectively connected to the two ends of the handle, each said end block having a first end rotatably connected to an associated one of said ends of the handle and a second end adapted to be connected to an end of a respective one of the inner tubes, each said link extending into said second end of a respective end block, and a button member mounted in the compartment of the handle and including two rods respectively extending outwardly from two ends thereof, each said rod being engaged with a respective one of said links for movement therewith to control the telescopic movements of the inner tubes relative to the outer tubes upon manual pressing of the button member.

2. The handle assembly according to claim 1, further comprising a spring mounted in the compartment of the handle and including a first end attached to the handle and a second end attached to the button member to return the button member to its initial position.

3. The handle assembly according to claim 1, further comprising two torsion springs respectively mounted to the ends of the handle, each said torsion spring including a first end securely attached to the associated end of the handle and a second end securely attached to an associated end block for returning the handle to its initial position.

* * * * *